US012674270B2

(12) United States Patent
Weidner et al.

(10) Patent No.: US 12,674,270 B2
(45) Date of Patent: Jul. 7, 2026

(54) DOOR ASSEMBLY FOR A LAUNDRY APPLIANCE

(71) Applicant: Haier US Appliance Solutions, Inc., Wilmington, DE (US)

(72) Inventors: Jordan Kyle Weidner, Louisville, KY (US); Venkata Chakradhar Rangu, Louisville, KY (US); Gary Bundy, Louisville, KY (US); Christopher Gene Vowels, County's Creek, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 90 days.

(21) Appl. No.: 18/776,987

(22) Filed: Jul. 18, 2024

(65) Prior Publication Data

US 2026/0022509 A1 Jan. 22, 2026

(51) Int. Cl.
*D06F 37/28* (2006.01)
*D06F 39/14* (2006.01)

(52) U.S. Cl.
CPC ..... *D06F 39/14* (2013.01); *D06F 37/28* (2013.01)

(58) Field of Classification Search
USPC ..... 68/3 R
See application file for complete search history.

(56) References Cited

U.S. PATENT DOCUMENTS

| | | | |
|---|---|---|---|
| 10,253,441 | B2 | 4/2019 | Anand et al. |
| 10,731,287 | B2 | 8/2020 | Heater et al. |
| 11,346,036 | B2 | 5/2022 | Mora et al. |
| 2021/0164147 | A1* | 6/2021 | Mora ..... D06F 21/04 |

FOREIGN PATENT DOCUMENTS

| | | | |
|---|---|---|---|
| CN | 109898299 | A | 6/2019 |
| CN | 214736795 | U | 11/2021 |
| CN | 112095304 | B | 8/2022 |
| CN | 117188113 | A | 12/2023 |
| EP | 2929077 | B1 | 9/2016 |

* cited by examiner

*Primary Examiner* — Levon J Shahinian
(74) *Attorney, Agent, or Firm* — Dority & Manning, P.A.

(57) ABSTRACT

A door assembly for a laundry appliance, the laundry appliance including a tub positioned within a cabinet and a basket rotatably mounted within the tub and defining a chamber for receiving of a load of clothes. The door assembly includes an outer door frame defining a frame pin that extends from an inner surface of the outer door frame, a reinforcement bracket positioned on the inner surface of the door assembly, the reinforcement bracket defining a frame pin aperture and a hinge bracket pin aperture, wherein the frame pin aperture is elongated along the lateral direction and configured to receive the frame pin, and a hinge bracket defining a hinge bracket aperture configured to receive the frame pin of the outer door frame and a hinge bracket pin configured for receipt within the hinge bracket pin aperture.

20 Claims, 8 Drawing Sheets

DOOR ASSEMBLY FOR A LAUNDRY APPLIANCE

FIELD OF THE INVENTION

The present subject matter relates generally to laundry appliances, or more specifically, to door assemblies of laundry appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Conventional washing machine appliances (or laundry appliances in general) include a door that is pivotally mounted to the cabinet over a front opening to provide selective access to the wash chamber. However, typical laundry appliance doors have trouble with door sag, specifically related to the striker alignment of the door. There are multiple components of these doors that contribute to striker alignment when it is opened and closed, including the reinforcement brackets, hinge bracket, and/or door handle. Improperly constraining the degrees of freedom of these components with insufficient locating features and/or fasteners adds more variation to the assembly and the striker alignment, as well as making assembly more difficult. Previous front load door designs have tried to locate these components to the outer door frame with insufficient locating features and/or fasteners. These designs do not properly constrain all the degrees of freedom of the bracket in the assembly and/or rely on the variation from screws to locate the part to the assembly.

Accordingly, a laundry appliance having an improved door would be desirable. More specifically, an appliance door that is easy to assemble while providing improved rigidity and striker alignment through the appliance lifetime with minimal cost and complexity would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a laundry appliance defining a vertical direction, a lateral direction, and a transverse direction is provided including a tub positioned within a cabinet, a basket rotatably mounted within the tub and defining a chamber for receiving of a load of clothes, and a door assembly rotatably mounted to the cabinet to provide selective access to the chamber. The door assembly includes an outer door frame defining a frame pin that extends from an inner surface of the outer door frame, a reinforcement bracket positioned on the inner surface of the door assembly, the reinforcement bracket defining a frame pin aperture and a hinge bracket pin aperture, wherein the frame pin aperture is elongated along the lateral direction and configured to receive the frame pin, and a hinge bracket defining a hinge bracket aperture configured to receive the frame pin of the outer door frame and a hinge bracket pin configured for receipt within the hinge bracket pin aperture.

In another exemplary embodiment, a door assembly for a laundry appliance is provided. The laundry appliance defines a vertical direction, a lateral direction, and a transverse direction and includes a tub positioned within a cabinet and a basket rotatably mounted within the tub and defining a chamber for receiving of a load of clothes. The door assembly includes an outer door frame defining a frame pin that extends from an inner surface of the outer door frame, a reinforcement bracket positioned on the inner surface of the door assembly, the reinforcement bracket defining a frame pin aperture and a hinge bracket pin aperture, wherein the frame pin aperture is elongated along the lateral direction and configured to receive the frame pin, and a hinge bracket defining a hinge bracket aperture configured to receive the frame pin of the outer door frame and a hinge bracket pin configured for receipt within the hinge bracket pin aperture.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
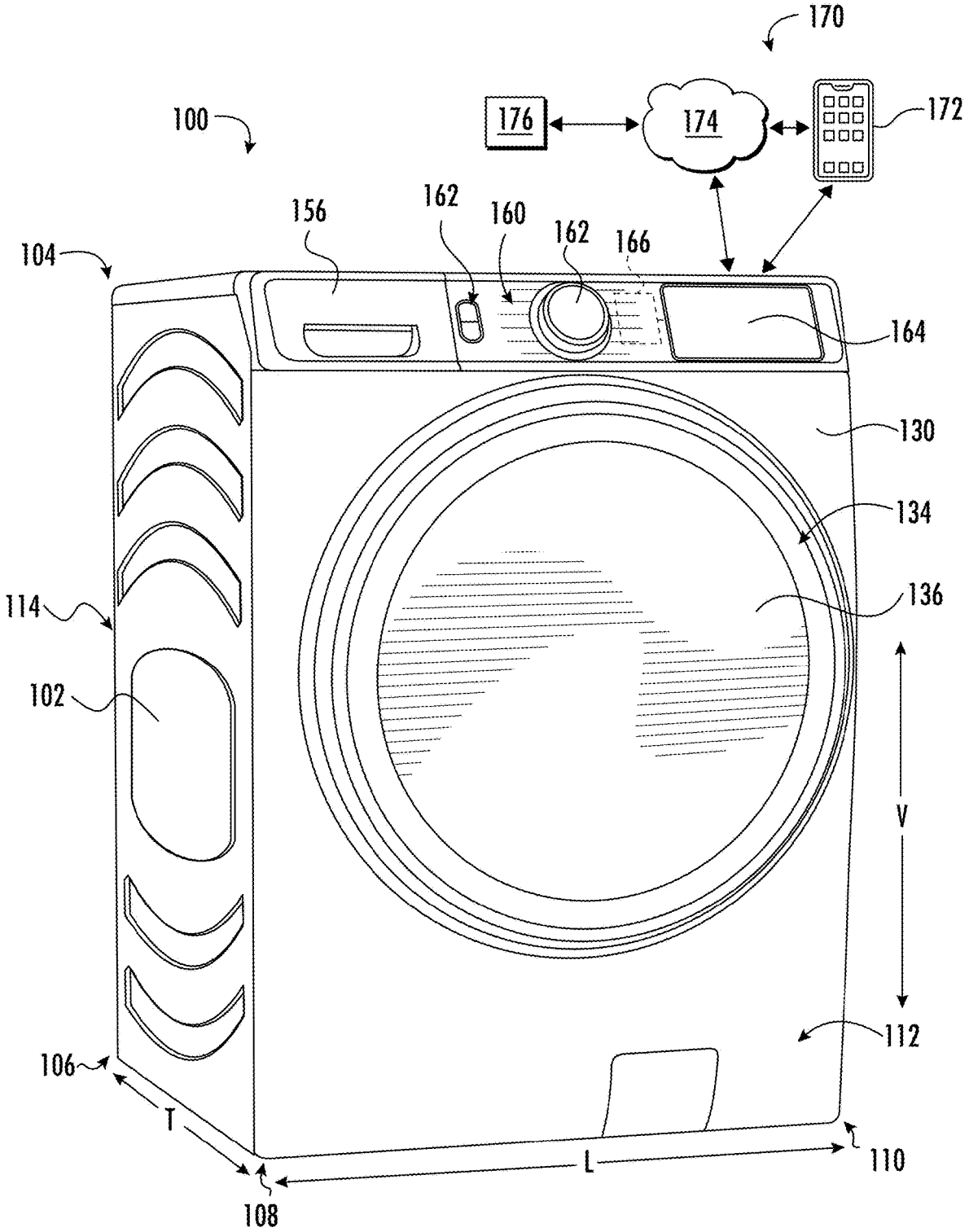
FIG. 1 provides a perspective view of a washing machine appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
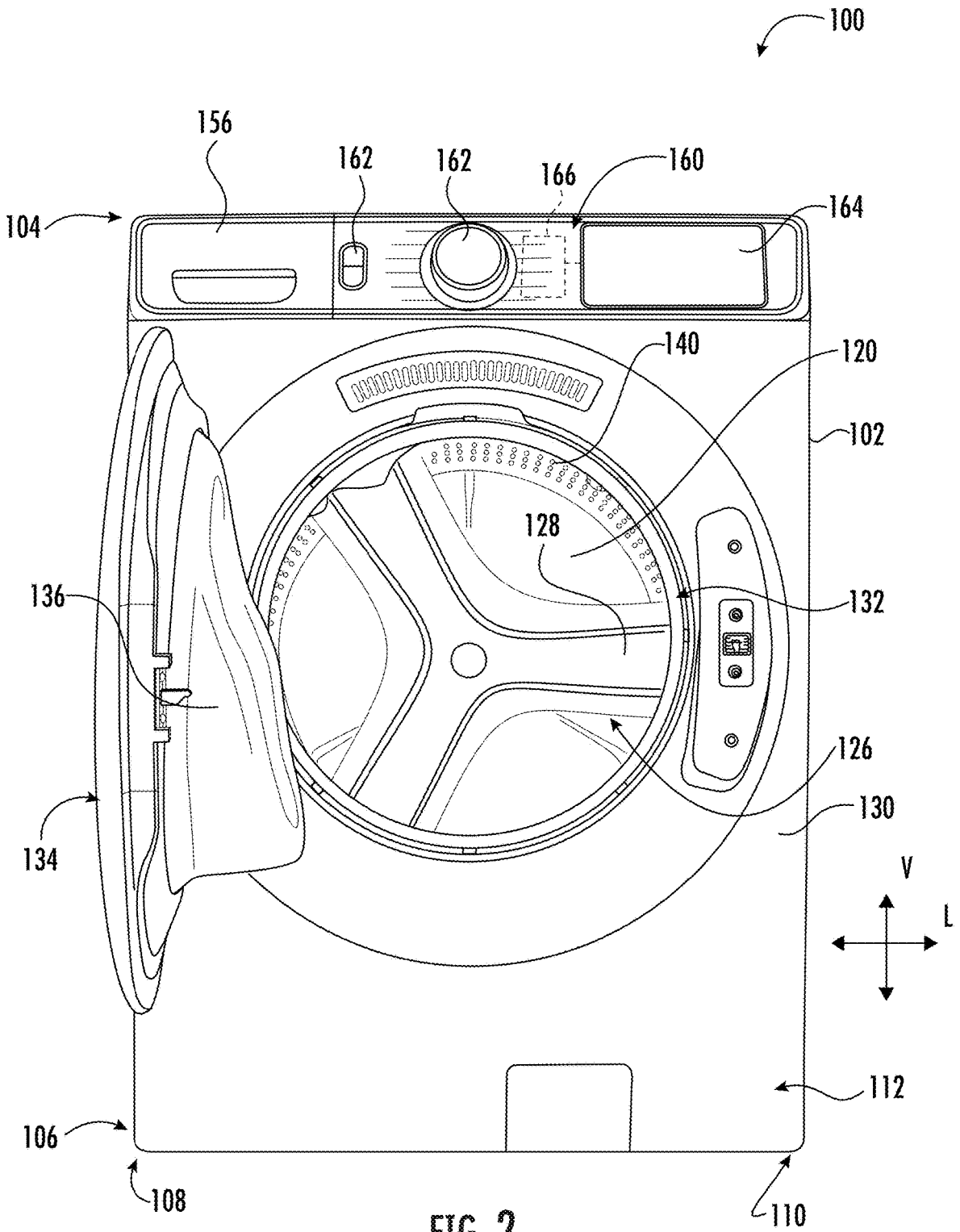
FIG. 2 provides a front view of the example washing machine appliance of FIG. 1 with a door assembly in the open position according to an example embodiment of the present subject matter.
Figure 3:
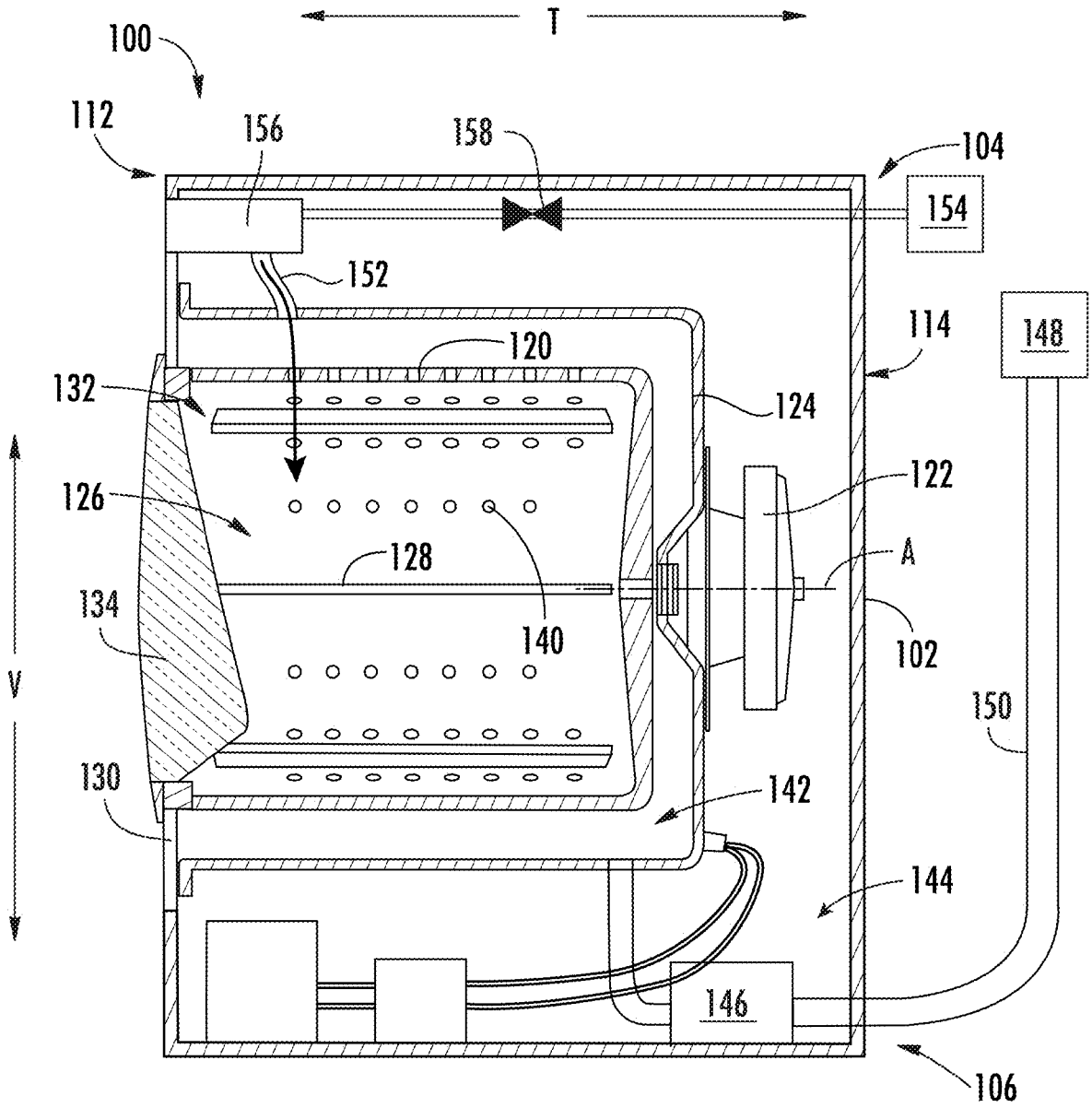
FIG. 3 provides a side cross-sectional view of the example washing machine appliance of FIG. 1 according to an example embodiment of the present subject matter.

Referring now to the figures, FIG. 1 is a perspective view of an exemplary horizontal axis washing machine appliance 100, FIG. 2 is a front view of washing machine appliance 100, and FIG. 3 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIGS. 2 and 3, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 3, a plurality of ribs 128 extends from basket 120 into wash chamber 126. In this manner, for example, ribs 128 may lift articles disposed in wash basket 120 during rotation of wash basket 120.

Referring generally to FIGS. 1 through 3, cabinet 102 also includes a front panel 130 which defines a chamber opening 132 that permits user access to wash basket 120 of wash tub 124. More specifically, washing machine appliance 100 includes a door 134 that is positioned over chamber opening 132 and is rotatably mounted to front panel 130. In this manner, door 134 permits selective access to chamber opening 132 by being movable between an open position (FIG. 2) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not labeled) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 3, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout (such as supply conduit 152) may be configured for directing a flow of fluid into wash tub 124. For example, supply conduit 152 may be in fluid communication with a water supply 154 (FIG. 3) in order to direct fluid (e.g., clean water or wash fluid) into wash tub 124. Supply conduit 152 may also be in fluid communication with the sump 142. For example, pump assembly 144 may direct wash fluid disposed in sump 142 to supply conduit 152 in order to circulate wash fluid in wash tub 124.

As illustrated in FIG. 3, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to supply conduit 152 to facilitate the complete and accurate dispensing of wash additive.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through chamber opening 132, and washing operation is initiated through operator manipulation of input selectors 162. Wash tub 124 is filled with water, detergent, and/or other fluid additives, e.g., via supply conduit 152 and or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through chamber opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Referring still to FIG. 1, a schematic diagram of an external communication system 170 will be described according to an exemplary embodiment of the present subject matter. In general, external communication system 170 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 170 may be used to transfer data or other information to improve performance of one or more external devices or appliances and/or improve user interaction with such devices.

For example, external communication system 170 permits controller 166 of washing machine appliance 100 to communicate with a separate device external to washing machine appliance 100, referred to generally herein as an external device 172. As described in more detail below, these communications may be facilitated using a wired or wireless connection, such as via a network 174. In general, external device 172 may be any suitable device separate from washing machine appliance 100 that is configured to provide and/or receive communications, information, data, or commands from a user. In this regard, external device 172 may be, for example, a personal phone, a smartphone, a tablet, a laptop or personal computer, a wearable device, a smart home system, or another mobile or remote device.

In addition, a remote server 176 may be in communication with washing machine appliance 100 and/or external device 172 through network 174. In this regard, for example, remote server 176 may be a cloud-based server 176, and is thus located at a distant location, such as in a separate state, country, etc. According to an exemplary embodiment, external device 172 may communicate with a remote server 176 over network 174, such as the Internet, to transmit/receive data or information, provide user inputs, receive user notifications or instructions, interact with or control washing machine appliance 100, etc. In addition, external device 172 and remote server 176 may communicate with washing machine appliance 100 to communicate similar information.

In general, communication between washing machine appliance 100, external device 172, remote server 176, and/or other user devices or appliances may be carried using any type of wired or wireless connection and using any suitable type of communication network, non-limiting examples of which are provided below. For example, external device 172 may be in direct or indirect communication with washing machine appliance 100 through any suitable wired or wireless communication connections or interfaces, such as network 174. For example, network 174 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Referring now also generally to FIGS. 4 through 13, and a door assembly 200 that may be used with washing machine appliance 100 will be described according to example embodiments of the present subject matter. In this regard, door assembly 200 may be the same as or replace door 134 as described above. In addition, although door assembly 200 is described herein as being used with washing machine appliance 100, it should be appreciated that door assembly 200 may be used on any other suitable laundry appliance, e.g., such as a dryer appliance, a combination washer/dryer appliance, or any other suitable appliance to provide selective access to an interior chamber through a front opening. Although an exemplary construction of door assembly 200 is described herein, it should be appreciated that variations and modifications may be made to the door assembly 200 while remaining within the scope of the present subject matter.

Figure 4:
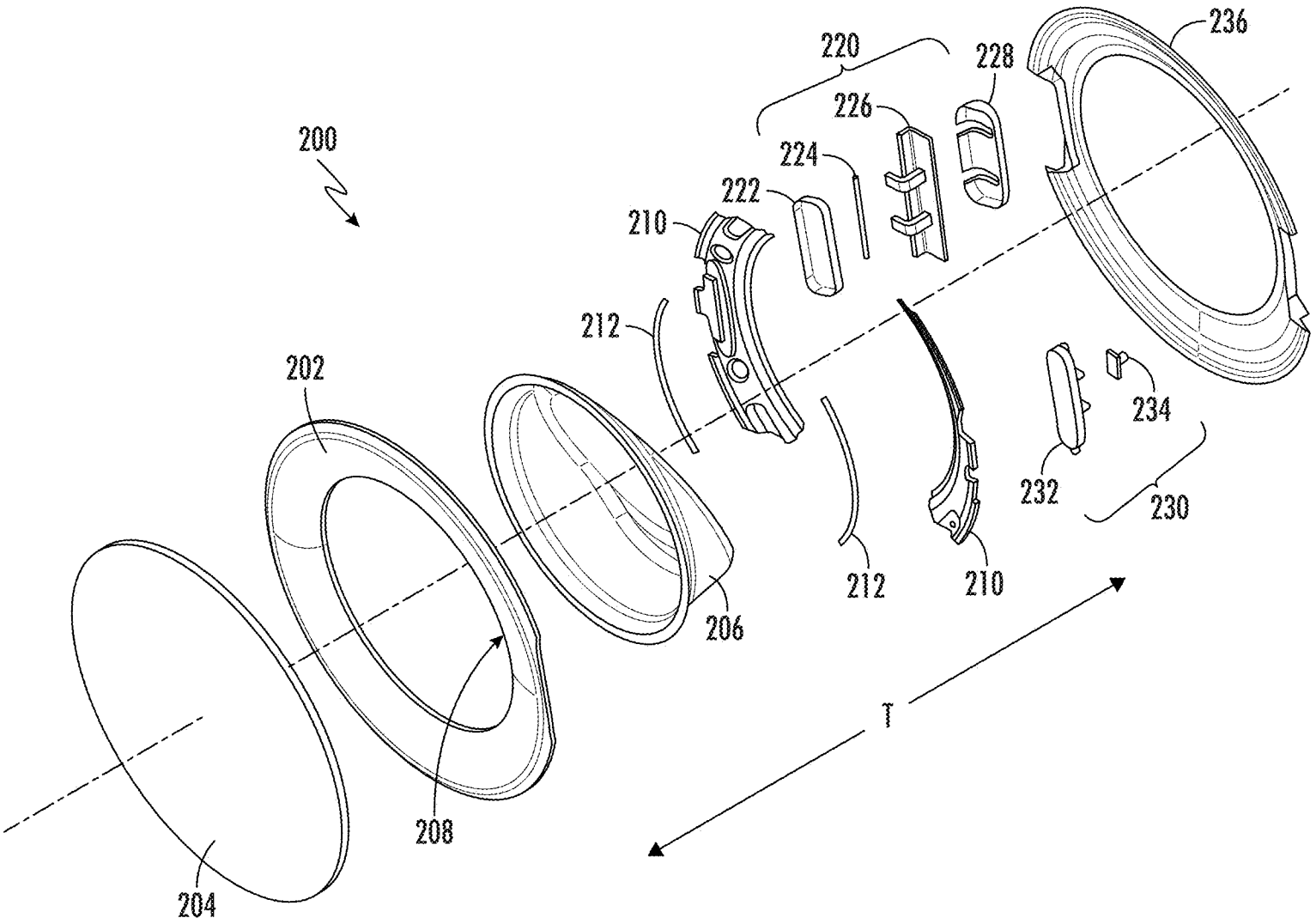
FIG. 4 provides an exploded view of the example door assembly of FIG. 2 according to an example embodiment of the present subject matter.
Figure 5:
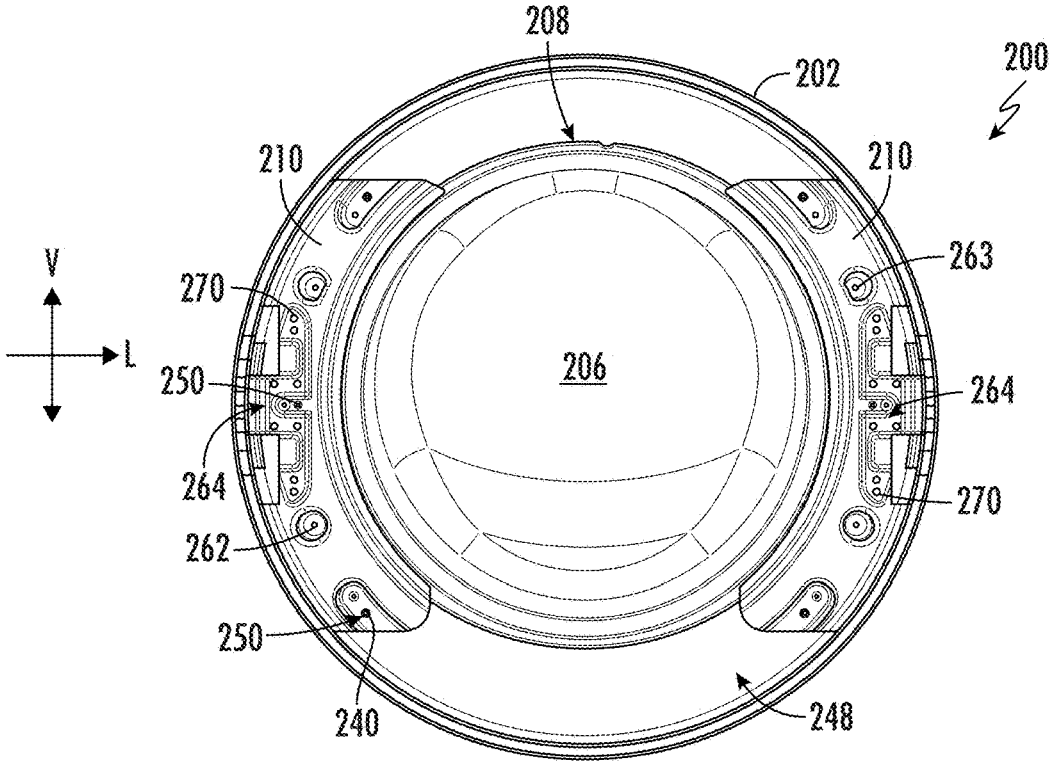
FIG. 5 provides a rear view of an outer door frame and reinforcement brackets of the example door assembly of FIG. 2 according to an example embodiment of the present subject matter.
Figure 6:
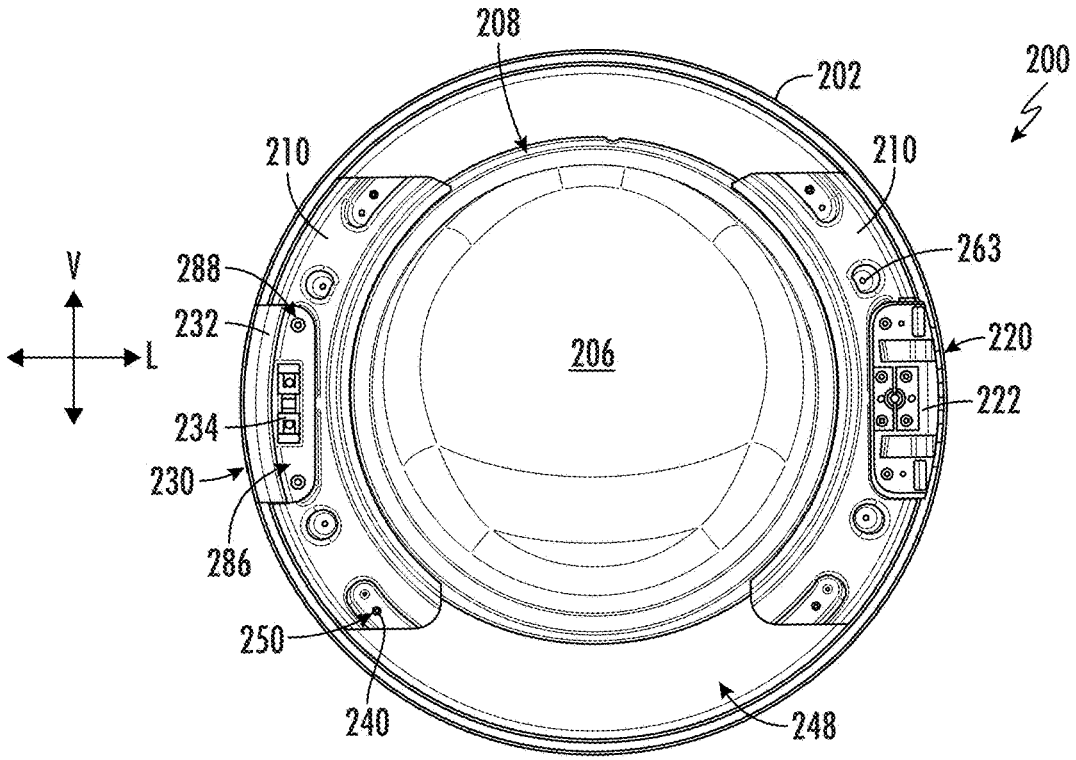
FIG. 6 provides a rear view of the example door assembly of FIG. 2 according to an example embodiment of the present subject matter.

As shown in the exploded view of FIG. 4, the door assembly 200 may generally include various components that are stacked along the transverse direction T. It should be appreciated that the directional orientation used to describe door assembly 200 may be similar to that used to describe the washing machine appliance 100, assuming door assembly 200 is in the closed position. Door assembly 200 may include an outer door frame 202 on which to an outer window 204 may be seated to provide a front appearance piece and contact area for door assembly 200. In addition, a glass door bowl 206 may be seated within a central aperture 208 of outer door frame 202. As will be described in more detail below, one or more reinforcement brackets 210 may be mounted to or attached to outer door frame 202 to secure glass bowl 206 to door frame 202 and to provide structural support for other attachment features of door assembly 200. According to the illustrated embodiment, door assembly 200 may include two reinforcement brackets 210 and two isolator strips 212 that are positioned between reinforcement brackets 210 and glass bowl 206 to secure glass bowl 206 to outer door frame 202.

According to the illustrated embodiment, the door assembly 200 may further include a hinge assembly 220 that is designed to attach door assembly 200 to the front panel 130 of cabinet 102. Hinge assembly 220 may generally be designed to support one side of door assembly 200 and permit rotation about a vertical axis to facilitate selective access to wash chamber 126 through chamber opening 132. For example, according to the illustrated embodiment, hinge assembly 220 may generally include a hinge bracket 222 that is mounted to reinforcement bracket 210 as described in more detail below. A hinge pin 224 may rotatably couple hinge bracket 222 to a door hinge 226. In addition, a hinge bracket cover 228 may be positioned over hinge bracket 222 to prevent pinching and conceal working components of hinge assembly 220.

In addition, door assembly 200 may include a handle assembly 230 that a user may grasp to open and close door assembly 200. Handle assembly 230 may also be used to secure or lock door assembly 200 in the closed position. For example, handle assembly 230 may generally include a handle body 232 that attaches to reinforcement bracket 210 on an opposite lateral side of the door assembly 200 relative to hinge assembly 220. A striker 234 may be mounted within or attached to handle body 232 for engaging a latching or locking mechanism positioned within front panel 130 of cabinet 102. In addition, door assembly 200 may include an inner door panel 236 that mounts to outer door frame 202 and conceals various components of door assembly 200.

It should be appreciated that various components of door assembly 200 may be formed from any suitably rigid and durable material. For example, outer door frame 202, hinge bracket 222, handle body 232, and other components may be injection molded from any suitable plastic material. For example, according to exemplary embodiments, these components may be formed by injection molding, e.g., using a suitable plastic material, such as injection molding grade Polybutylene Terephthalate (PBT), Nylon 6, high impact polystyrene (HIPS), acrylonitrile butadiene styrene (ABS), polypropylene (PP), glass/talc filled polypropylene, or any other suitable blend of polymers. Alternatively, according to the exemplary embodiment, these components may be compression molded, e.g., using sheet molding compound (SMC) thermoset plastic or other thermoplastics. According to still other embodiments, portions of door assembly 200 may be formed from any other suitable rigid material. According to example embodiments, reinforcement brackets 210, hinge pin 224, and other components of door assembly 200 may be formed from metal, e.g., such as stamped, rolled, or otherwise formed sheet metal.

Notably, as described briefly above, conventional door assemblies experience issues with door sag, particularly after prolonged use. When these doors sag, the door strikers often become misaligned with corresponding latch assemblies of the laundry appliances. This may result in the inability to close and/or lock the door, operational issues, and user dissatisfaction. Accordingly, aspects of the present subject matter are directed to a door assembly 200 with improved alignment features, attachment features, and simplified assembly. Although an exemplary construction is described herein, it should be appreciated that variations and modifications may be made while remaining within the scope of the present subject matter. In addition, it should be appreciated that although one configuration of door assembly 200 is described where the hinge assembly 220 is on the left and the handle assembly 230 is on the right, these components may be swapped or interchangeable for a reversible door.

According to the illustrated embodiment, outer door frame 202 may define a plurality of frame pins (e.g., identified herein generally by reference numeral 240). These frame pins may be configured for receipt within corresponding apertures on reinforcement brackets 210, hinge bracket 222, and/or handle body 232 to facilitate proper alignment, reduced door sag, and simplified door assembly. Specifically, according to the illustrated embodiment, frame pins 240 may include a first frame pin 242, a second frame pin 244, and a third pin 246, each of which extend from an inner surface 248 of outer door frame 202 along the transverse direction T. Although three frame pins 240 are used herein to describe the attachment of reinforcement bracket 210 to one side of door assembly 200, it should be appreciated that outer door frame 202 may define similar or complementary frame pins 240 on the opposite side of door assembly 200, e.g., for attaching one or both of hinge assembly 220 and handle assembly 230. These frame pins 240 may also be identified herein using reference numerals 242-246. In addition, although frame pins 240 are illustrated herein as being cylindrical pins, it should be appreciated that frame pins may alternatively refer to any protrusion or feature having any suitable size, geometry, or configuration, such as tabs, cones, or any other suitable protruding locating features.

According to the illustrated embodiment, reinforcement bracket 210 is positioned on inner surface 248 of outer door frame 202. As shown, reinforcement bracket 210 defines a plurality of pin apertures 250 that are generally configured for receiving frame pins 240 to facilitate proper location of reinforcement bracket 210 and to simplify the installation process. Specifically, reinforcement bracket 210 may define a first pin aperture 252, a second pin aperture 254, and a third pin aperture 256 which correspond to frame pins 242-246. As described in more detail below, the geometry of pin apertures 250 may be varied in order to facilitate case of installation of reinforcement brackets 210 while ensuring that reinforcement brackets 210 are constrained in all degrees of freedom.

For example, according to the illustrated embodiment, first pin aperture 252 is configured to receive first frame pin 242 and second pin aperture 254 is configured to receive second frame pin 244. According to the illustrated embodiment, one or both of first pin aperture 252 and second pin aperture 254 may be elongated along the vertical direction V. In this manner, placement of reinforcement bracket 210 may be quick and easy while relative movement between reinforcement bracket 210 and outer door frame 202 is constrained along the lateral direction L. According to still other embodiments, it should be appreciated that one of the first pin aperture 252 and second pin aperture 254 may be circular and sized similarly to the corresponding frame pin 242 to also prevent relative motion along the vertical direction V.

In addition, according to the illustrated embodiment, third pin aperture 256 may be elongated along the lateral direction L, e.g., thereby preventing relative movement between reinforcement bracket 210 and outer door frame 202 along the vertical direction V. In this manner, when frame pins 240 engage pin apertures 250, relative motion between reinforcement bracket 210 and outer door frame 202 may be restricted in both the vertical direction V and in the lateral direction L. In addition, the engagement between frame pins 240 and pin apertures 250 may prevent rotation about the transverse direction T. Moreover, this restriction of the degrees of freedom may be achieved without tight tolerances or over-constrained parts, thereby simplifying assembly of these components of door assembly 200.

According to example embodiments, door assembly 200 may further include a plurality of mechanical fasteners 260, e.g., such as mechanical screws, that are used to attach reinforcement bracket 210 to outer door frame 202. In this regard, outer door frame 202 may define a plurality of screw bosses 262 that are configured to securely receive mechanical fasteners 260. Accordingly, by passing mechanical fasteners 260 through reinforcement bracket 210 and into screw bosses 262, the relative movement between reinforcement bracket 210 and outer door frame 202 may be restrained along the transverse direction T. Accordingly, once mechanical fasteners 260 are installed, relative motion between these components may be restrained in all degrees of freedom. According to the illustrated embodiment, outer door frame 202 may define screw bosses 262 adjacent each of frame pins 240, though other positioning may be used while remaining within the scope of the present subject matter.

According to the illustrated embodiment, reinforcement brackets 210 may further define a mounting structure 264 that is complementary to and is configured to receive one or both of hinge assembly 220 and the handle assembly 230. In this regard, the geometry of mounting structure 264 may be used to prevent relative motion between hinge assembly 220, handle assembly 230, and reinforcement brackets 210 after proper installation. Although an exemplary mounting structure 264 is illustrated herein, it should be appreciated that variations and modifications may be made while remaining within the scope of the present subject matter.

Figure 7:
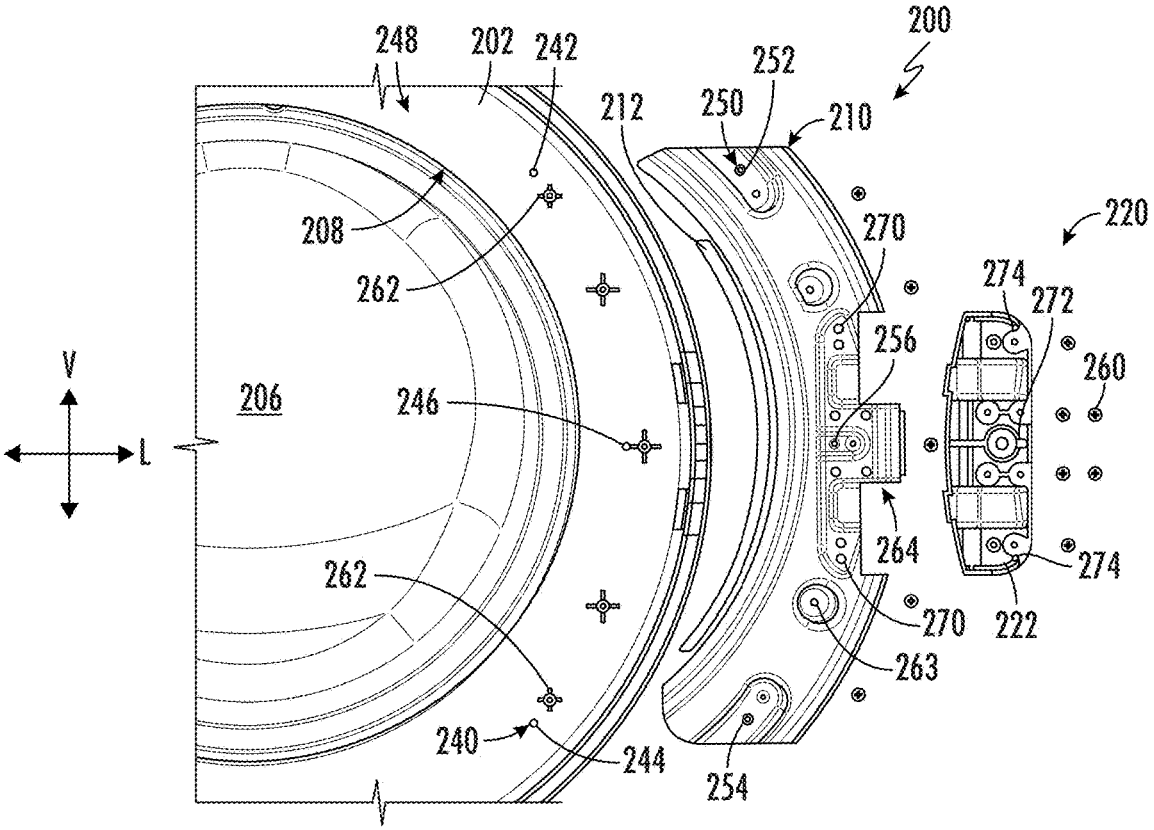
FIG. 7 provides another exploded view of the example door assembly of FIG. 2 according to an example embodiment of the present subject matter.
Figure 8:
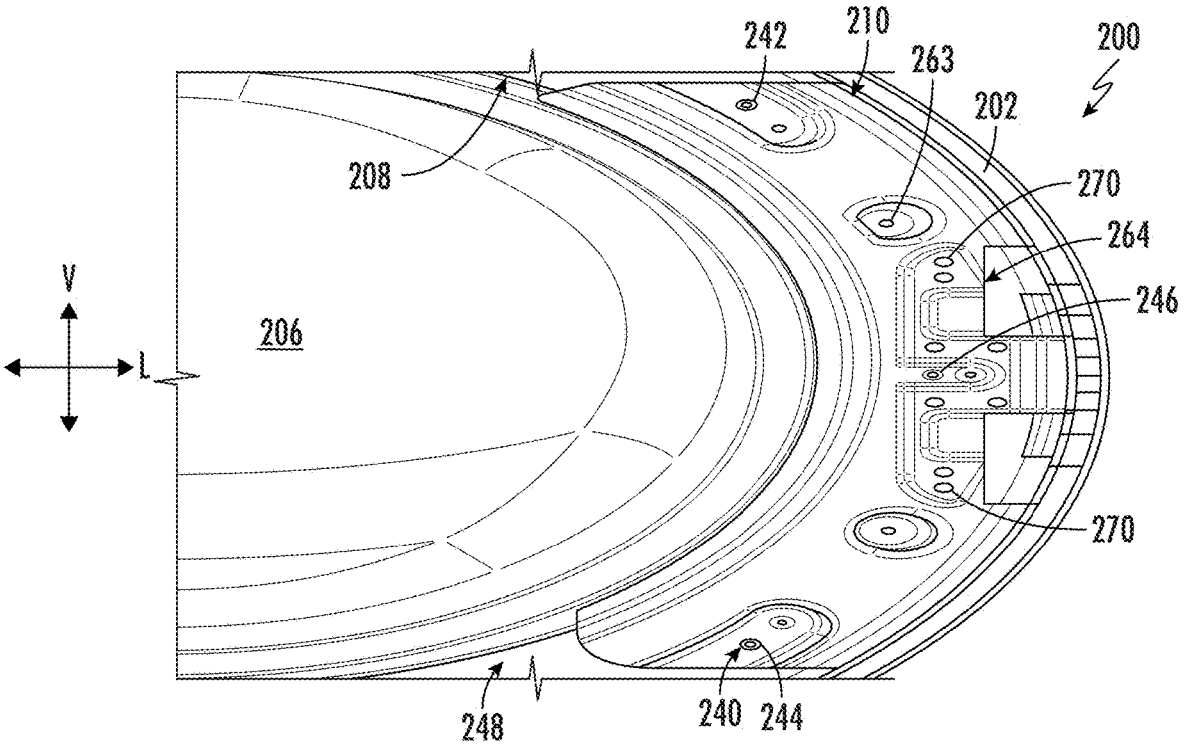
FIG. 8 provides a close-up rear view of the example door assembly of FIG. 2 according to an example embodiment of the present subject matter.
Figure 9:
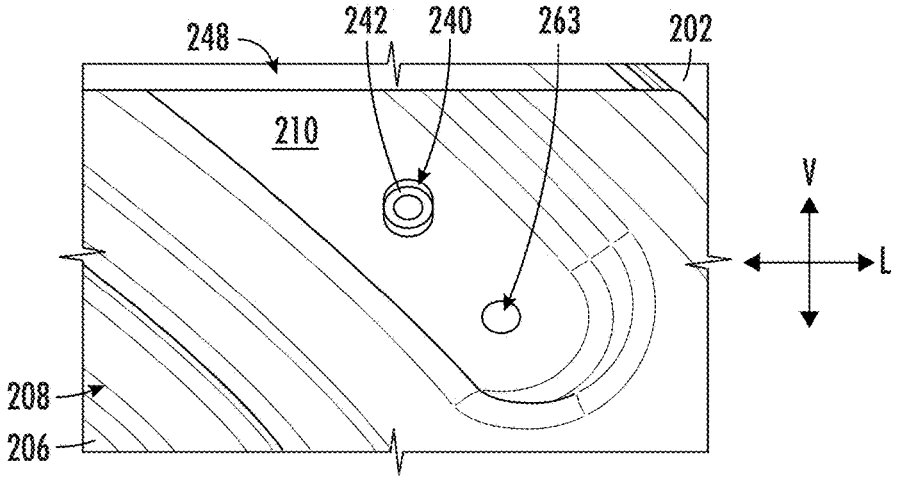
FIG. 9 provides a close-up rear view of the example door assembly of FIG. 2 according to an example embodiment of the present subject matter.
Figure 10:
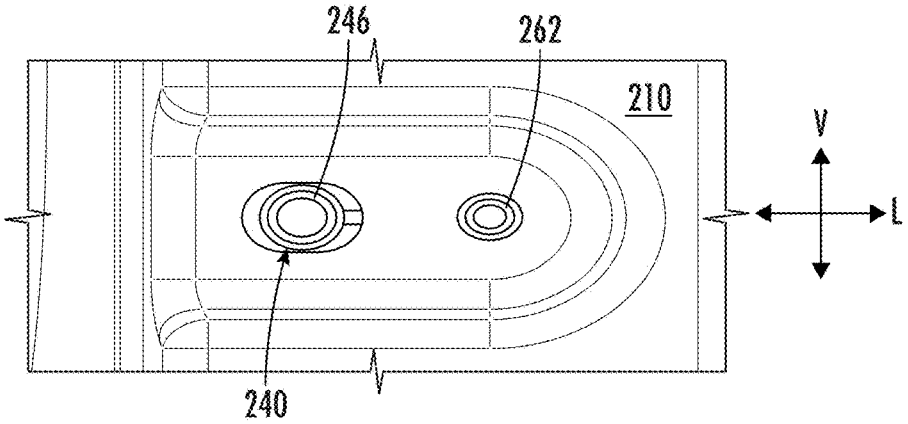
FIG. 10 provides a close-up rear view of the example door assembly of FIG. 2 according to an example embodiment of the present subject matter.
Figure 11:
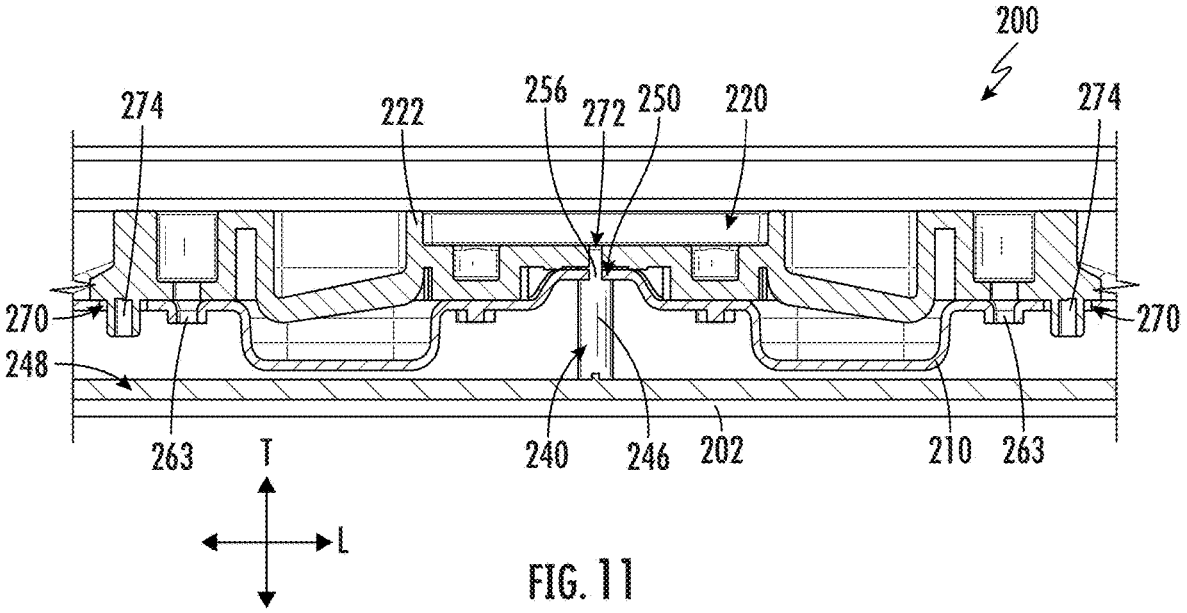
FIG. 11 provides a cross-sectional view of the example door assembly of FIG. 2 according to an example embodiment of the present subject matter.

Referring now specifically to FIGS. 7 and 11, the attachment of hinge assembly 220 will be described in more detail according to an example embodiment. Specifically, according to the illustrated embodiment, reinforcement bracket 210 may further define a hinge bracket pin aperture 270. In addition, hinge bracket 222 may generally define a hinge bracket aperture 272 and one or more hinge bracket pins 274. According to the illustrated embodiment, third frame pin 246 of outer door frame 202 may be elongated, e.g., relative to the first frame pin 242 and second frame pin 244. In this manner, third frame pin 246 may pass through both third pin aperture 256 of reinforcement bracket 210 and hinge bracket aperture 272 of hinge bracket 222. Similar to third pin aperture 256, hinge bracket aperture 272 may be elongated along the lateral direction L and third frame pin 246 may engage hinge bracket aperture 272 to prevent relative movement between outer door frame 202 and hinge bracket 222 along the vertical direction V. According to the illustrated embodiment, hinge bracket 222 defines two hinge bracket pins 274 that extend along the vertical direction V (e.g., aligned along the vertical direction V) and configured for receipt within corresponding hinge bracket pin apertures 270 defined on reinforcement bracket 210. However, it should be appreciated that other configurations are possible and within the scope of the present subject matter. For example, although hinge bracket pins 274 are illustrated herein as being cylindrical pins, it should be appreciated that hinge bracket pins may alternatively refer to any protrusion or feature having any suitable size, geometry, or configuration, such as tabs, cones, or any other suitable protruding locating features.

According to the illustrated embodiment, outer door frame 202 and/or reinforcement brackets 210 may define additional screw bosses 262 for receiving mechanical fasteners 260 to secure hinge bracket 222 to door assembly 200. In addition, reinforcement bracket 210 may define one or more screw holes or through holes 263 that mechanical fasteners 260 may pass through before engaging screw bosses 262. In this regard, by passing mechanical fasteners 260 through hinge bracket 222 and into screw holes 263 defined on reinforcement bracket 210 or outer door frame 202, hinge assembly 220 may be properly attached to the door assembly 200. It should be appreciated that the construction and attachment mechanisms may be the same, similar, or interchangeable between that described herein for hinge assembly 220 and handle assembly 230.

Figure 12:
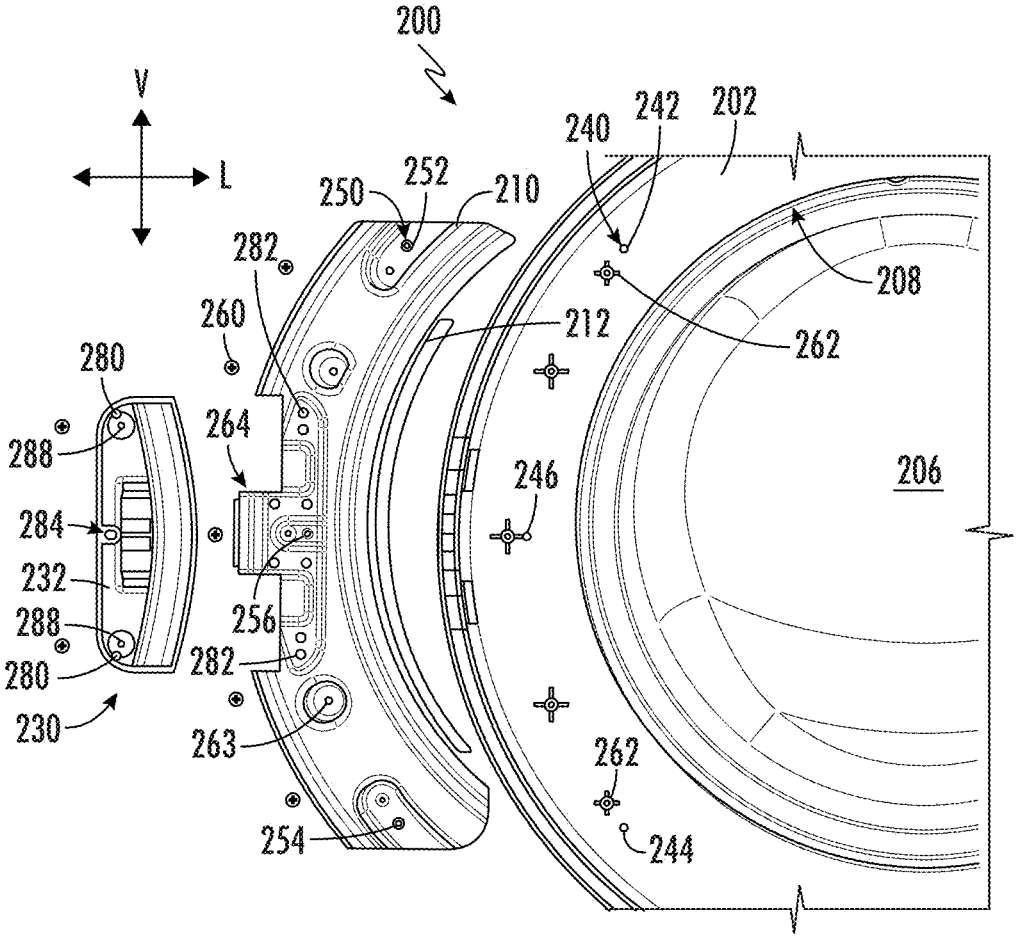
FIG. 12 provides another exploded view of the example door assembly of FIG. 2 according to an example embodiment of the present subject matter.
Figure 13:
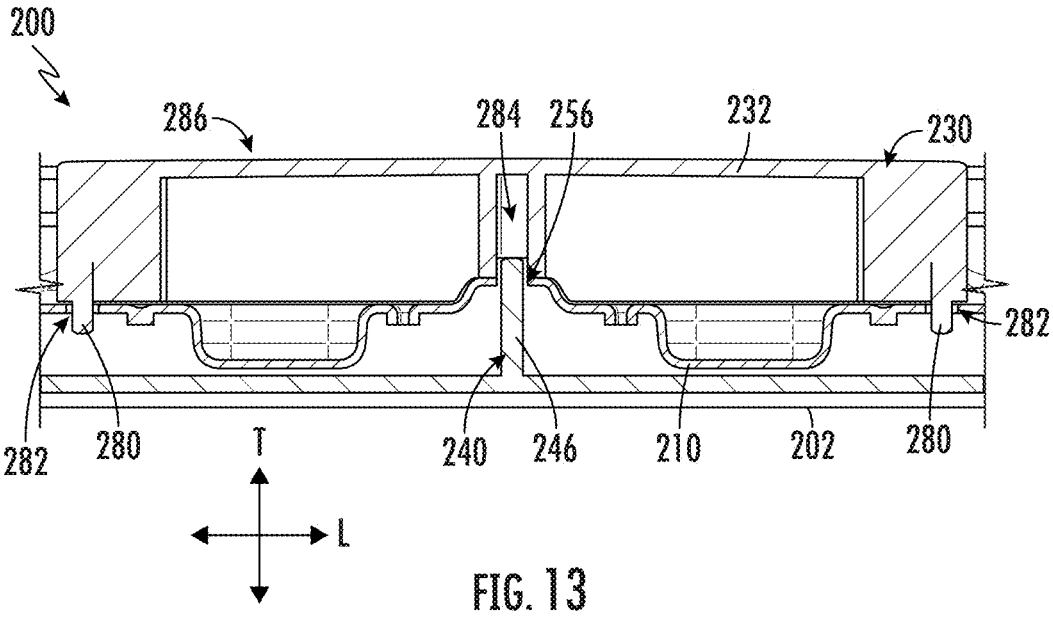
FIG. 13 provides a cross-sectional view of the example door assembly of FIG. 2 according to an example embodiment of the present subject matter.

Referring now specifically to FIGS. 12 and 13, the manner of attaching handle assembly 230 to door assembly 200 will be described according to an example embodiment of the present subject matter. It should be noted that in FIG. 12, and handle body 232 is turned upside down to reveal attachment features for engaging reinforcement bracket 210. According to the illustrated embodiment, door handle body 232 defines one or more handle pins 280 configured for receipt within a handle pin aperture 282. In this regard, hinge bracket pin aperture 270 may be the same or similar as handle pin aperture 282, e.g., depending on whether hinge assembly 220 or handle assembly 230 is attached on that side of door assembly 200. According to the illustrated embodiment, two handle pins 280 are illustrated and spaced apart along the vertical direction V, though other pin configurations are possible and within the scope of the present subject matter. For example, although handle pins 280 are illustrated herein as being cylindrical pins, it should be appreciated that handle pins may alternatively refer to any protrusion or feature having any suitable size, geometry, or configuration, such as tabs, cones, or any other suitable protruding locating features.

In addition, according to the illustrated embodiment, handle body 232 may define a handle body aperture 284 that is configured to receive a third frame pin 246 of outer door frame 202. In addition, door handle body 232 may define a contact surface 286 that conceals handle body aperture 284 and provides an engagement surface for user interaction with handle assembly 230. According to an example embodiment, handle body aperture 284 may be elongated along the lateral direction L and third frame pin 246 may engage handle body aperture 284 to prevent relative movement between outer door frame 202 and door handle body 232 along the vertical direction V. According to still other embodiments, handle body aperture 284 may restrict relative movement along both lateral direction L and vertical direction V. Indeed, handle body aperture 284 may have any suitable geometry for receiving third frame pin 246.

According to the illustrated embodiment, handle body 232 may further define one or more through holes 288 that are configured for receiving mechanical fasteners 260 and attaching handle body 232. In this regard, mechanical fasteners 260 may pass through the through holes 288 on handle body 232, and into screw holes 263 on reinforcement bracket 210. In this manner, these mechanical fasteners 260 may prevent relative movement between handle body 232 and reinforcement bracket 210 along the transverse direction T, thereby restricting movement of handle body 232 within all degrees of freedom.

As explained herein, aspects of the present subject matter are generally directed to a front load washer door assembly. The door hinge bracket may be located and assembled to the outer door frame and reinforcement bracket via two pins and a slot: two pins at the top and bottom of the backside of the bracket and one horizontal slot in the middle. The top and bottom pins of the hinge bracket may be inserted into vertical slots of the reinforcement bracket. Further, the same center pin from the outer door frame that protrudes and locates the reinforcement bracket may pass through the center slot of the hinge bracket. Additionally, properly constraining all degrees of freedom of the hinge bracket with two pins and a horizontal slot allows for better variation control of the door striker alignment to door latch, and location of the hinge bracket in the door assembly itself.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance defining a vertical direction, a lateral direction, and a transverse direction, the laundry appliance comprising:

a tub positioned within a cabinet;

a basket rotatably mounted within the tub and defining a chamber for receiving of a load of clothes; and a door assembly rotatably mounted to the cabinet to provide selective access to the chamber, the door assembly comprising:

an outer door frame defining a frame pin that extends from an inner surface of the outer door frame;

a reinforcement bracket positioned on the inner surface of the door assembly, the reinforcement bracket defining a frame pin aperture and a hinge bracket pin aperture, wherein the frame pin aperture is elongated along the lateral direction, being wider than it is tall, and being configured to receive the frame pin such that it is constrained along the vertical direction but not along the lateral direction; and a hinge bracket defining a hinge bracket aperture configured to receive the frame pin of the outer door frame and a hinge bracket pin configured for receipt within the hinge bracket pin aperture.

2. The laundry appliance of claim 1, wherein the frame pin aperture is elongated along the lateral direction and the frame pin engages the frame pin aperture to prevent relative movement between the outer door frame and the reinforcement bracket along the vertical direction.

3. The laundry appliance of claim 1, wherein the frame pin aperture is circular and the frame pin engages the frame pin aperture to prevent relative movement between the outer door frame and the reinforcement bracket along the lateral direction and the vertical direction.

4. The laundry appliance of claim 1, wherein the hinge bracket aperture is elongated along the lateral direction and the frame pin engages the hinge bracket aperture to prevent relative movement between the outer door frame and the hinge bracket along the vertical direction.

5. The laundry appliance of claim 1, wherein the hinge bracket aperture is circular and the frame pin engages the hinge bracket aperture to prevent relative movement between the outer door frame and the hinge bracket along the lateral direction and the vertical direction.

6. The laundry appliance of claim 1, wherein the hinge bracket pin aperture is a first hinge bracket pin aperture, the hinge bracket pin is a first hinge bracket pin, the reinforcement bracket further defines a second hinge bracket pin aperture, and the hinge bracket further defines a second hinge bracket pin configured for receipt within the second hinge bracket pin aperture.

7. The laundry appliance of claim 6, wherein the first hinge bracket pin and the second hinge bracket pin are aligned along the vertical direction.

8. The laundry appliance of claim 1, wherein the reinforcement bracket is positioned between the hinge bracket and the outer door frame.

9. The laundry appliance of claim 1, wherein the reinforcement bracket defines a plurality of through holes and a plurality of screw holes, the door assembly further comprising:

mechanical fasteners that are inserted through the hinge bracket, through the plurality of through holes on the reinforcement bracket, and into the plurality of screw holes to prevent relative movement between the hinge bracket, the reinforcement bracket, and the outer door frame along the transverse direction.

10. The laundry appliance of claim 1, wherein the hinge bracket is injection molded as a single, integral piece.

11. The laundry appliance of claim 1, wherein the door assembly further comprises:

a window mounted within a central opening of the outer door frame, the window being positioned between the outer door frame and the reinforcement bracket along the transverse direction.

12. The laundry appliance of claim 1, wherein the laundry appliance is a front load washing machine appliance or a front load dryer appliance.

13. A door assembly for a laundry appliance, the laundry appliance defining a vertical direction, a lateral direction, and a transverse direction, the laundry appliance comprising a tub positioned within a cabinet and a basket rotatably mounted within the tub and defining a chamber for receiving of a load of clothes, the door assembly comprising:

an outer door frame defining a frame pin that extends from an inner surface of the outer door frame;

a reinforcement bracket positioned on the inner surface of the door assembly, the reinforcement bracket defining a frame pin aperture and a hinge bracket pin aperture, wherein the frame pin aperture is elongated along the lateral, being wider than it is tall, and being configured to receive the frame pin such that it is constrained along the vertical direction but not along the lateral direction; and a hinge bracket defining a hinge bracket aperture configured to receive the frame pin of the outer door frame and a hinge bracket pin configured for receipt within the hinge bracket pin aperture.

14. The door assembly of claim 13, wherein the frame pin aperture is elongated along the lateral direction and the frame pin engages the frame pin aperture to prevent relative movement between the outer door frame and the reinforcement bracket along the vertical direction.

15. The door assembly of claim 13, wherein the frame pin aperture is circular and the frame pin engages the frame pin aperture to prevent relative movement between the outer door frame and the reinforcement bracket along the lateral direction and the vertical direction.

16. The door assembly of claim 13, wherein the hinge bracket aperture is elongated along the lateral direction and the frame pin engages the hinge bracket aperture to prevent relative movement between the outer door frame and the hinge bracket along the vertical direction.

17. The door assembly of claim 13, wherein the hinge bracket aperture is circular and the frame pin engages the hinge bracket aperture to prevent relative movement between the outer door frame and the hinge bracket along the lateral direction and the vertical direction.

18. The door assembly of claim 13, wherein the hinge bracket pin aperture is a first hinge bracket pin aperture, the hinge bracket pin is a first hinge bracket pin, the reinforcement bracket further defines a second hinge bracket pin aperture, and the hinge bracket further defines a second hinge bracket pin configured for receipt within the second hinge bracket pin aperture.

19. The door assembly of claim 18, wherein the first hinge bracket pin and the second hinge bracket pin are aligned along the vertical direction.

20. The door assembly of claim 13, wherein the reinforcement bracket is positioned between the hinge bracket and the outer door frame.

* * * * *